United States Patent [19]

Bennett

[11] 4,107,693

[45] Aug. 15, 1978

[54] ANTENNA MOUNTING DEVICE

[75] Inventor: Cleatus W. Bennett, St. Ann, Mo.

[73] Assignee: The Raymond Lee Organization, Inc., New York, N.Y. ; a part interest

[21] Appl. No.: 796,229

[22] Filed: May 12, 1977

[51] Int. Cl.[2] ..... H01Q 1/32

[52] U.S. Cl. ..... 343/715; 248/539

[58] Field of Search ..... 343/711-715, 343/881, 882; 248/539, 514, 225.4

[56] References Cited

U.S. PATENT DOCUMENTS 4,035,806 7/1977 Powell ..... 343/715

*Primary Examiner*—Alfred E. Smith
*Assistant Examiner*—David K. Moore
*Attorney, Agent, or Firm*—Daniel Jay Tick

[57] ABSTRACT

A radio antenna is affixed to a rotary mounting device on an arm extending from a bracket member. The bracket member is affixed to an automotive vehicle via a spring biased stud whereby the bracket member is movable to position the antenna in a storage position in which it is out of sight of people out of the vehicle.

3 Claims, 4 Drawing Figures

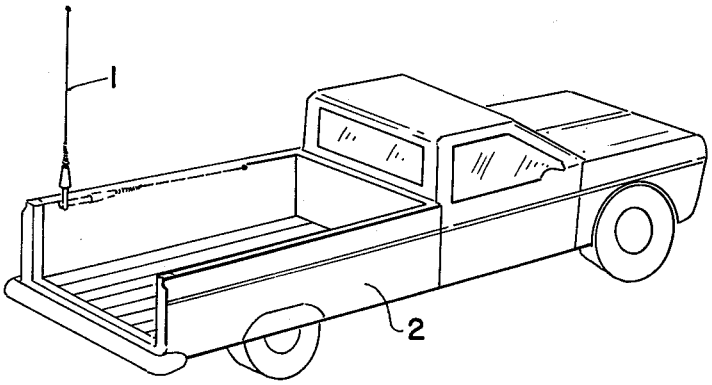
FIG. 1
FIG. 4
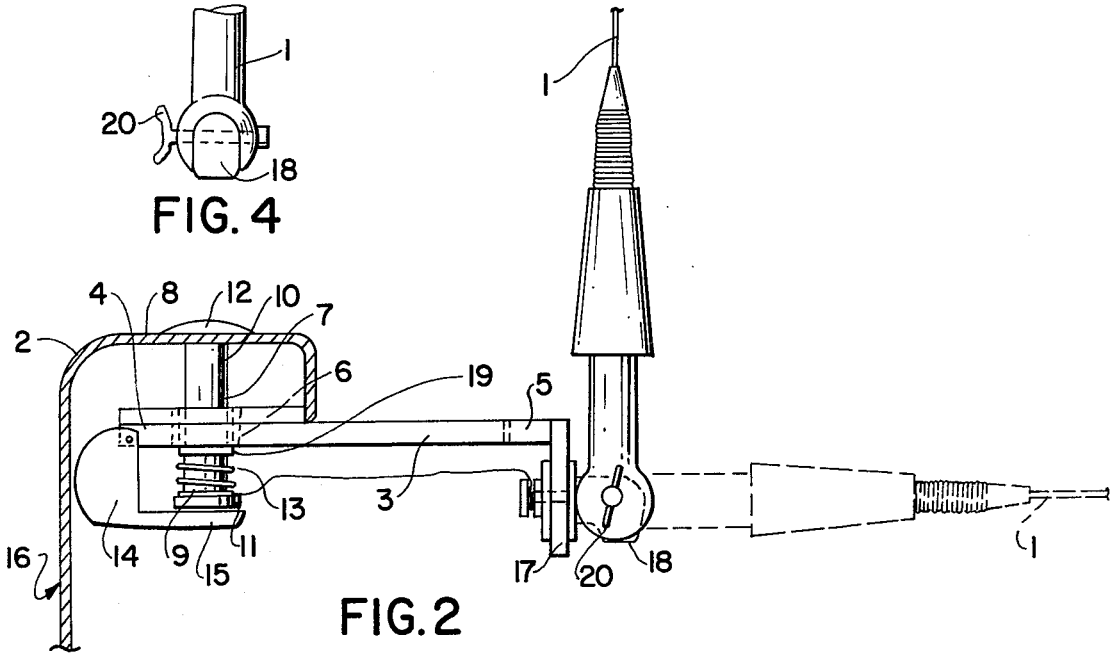
FIG. 2
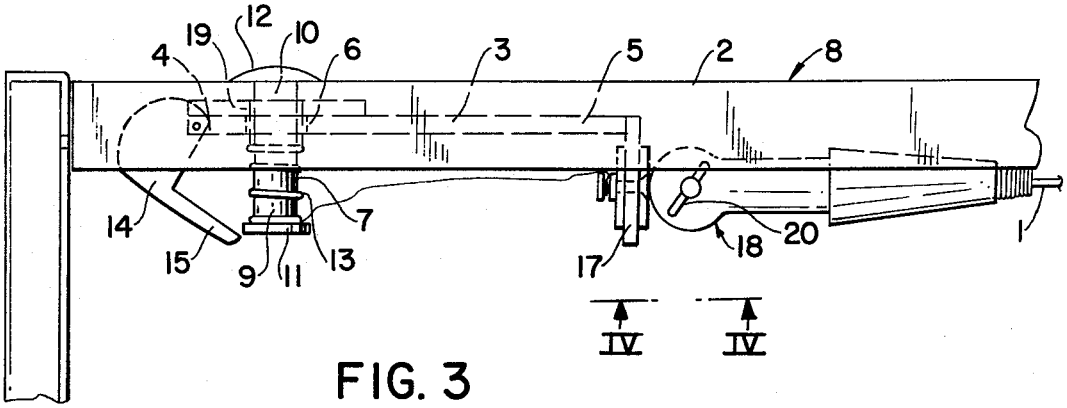
FIG. 3

ANTENNA MOUNTING DEVICE

BACKGROUND OF THE INVENTION

The present invention relates to an antenna mounting device. More particularly, the invention relates to an antenna mounting device for mounting a radio antenna, especially the antenna of a citizen's band radio, on an automotive vehicle, especially a pickup truck.

Objects of the invention are to provide an antenna mounting device of simple structure, which is inexpensive in manufacture, installed with facility and convenience on an automotive vehicle, and especially a pickup truck, and functions efficiently, effectively and reliably to store the antenna in a storage position in which it is out of sight to people out of the vehicle, and is therefore relatively safe from theft or vandalism.

BRIEF DESCRIPTION OF THE DRAWINGS:

In order that the invention may be readily carried into effect, it will now be described with reference to the accompanying drawings, wherein:

FIG. 1 is a view of an antenna mounted on a pickup truck via the antenna mounting device of the invention;

FIG. 2 is a view, on an enlarged scale, partly in section, of an embodiment of the antenna mounting device of the invention, as mounted on a pickup truck, with the antenna in its extended position;

FIG. 3 is a view, on an enlarged scale, of the embodiment of FIG. 2 with the antenna in its storage position; and FIG. 4 is a view, taken along the lines IV-IV, of FIG. 3.

DETAILED DESCRIPTION OF THE INVENTION

The antenna mounting device of the invention is for mounting a radio antenna 1 (FIGS. 1 to 3), and especially the antenna of a citizen's band radio, on an automotive vehicle, and especially a pickup truck 2 (FIGS. 1 to 3).

The antenna mounting device of the invention comprises a bracket member 3 having spaced opposite first and second ends 4 and 5, respectively (FIGS. 2 and 3). The bracket member 3 has a bore 6 formed therethrough in the area of the first end 4 thereof (FIGS. 2 and 3).

A stud 7 extends through the bore 6 of the bracket member 3 and is mounted on the vehicle 2. In the example of the present invention, the stud 7 is mounted on, or through, the upper surface 8 (FIGS. 2 and 3) of the left side of the pickup truck 2 in the area of the rear thereof. The stud 7 has spaced opposite ends 9 and 10 and a head 11 and 12, respectively, at each end (FIGS. 2 and 3).

A spiral spring 13 is coaxially positioned on the stud 7 and extends between the head 11 of the stud and the bracket member 3 (FIGS. 2 and 3).

A cam member 14 is pivotally affixed to the bracket member 3 at the first end 4 thereof and has a projecting portion 15 abutting the head 11 of the stud 7 in one position, shown in FIG. 2, to raise the bracket member on the stud, or move it away from the top 8 of the side of the vehicle 2, and is spaced from the stud in another position to lower the bracket member, or move it closer to said top of said side, as shown in FIG. 3.

When the spring 13 is compressed in the manner shown in FIG. 2, and the bracket 3 is at it's maximum distance from the top 8 of the side of the vehicle 2, the bracket is manually pivoted about the stud 7 so that it extends substantially perpendicularly to the outside surface 16 (FIG. 2) of said side of said vehicle so that the antenna may be positioned in it's extended position. When the spring 13 is expanded in the manner shown in FIG. 3, due to the spacing of the projecting portion 15 of the cam 14 from the head 11 of the stud 7, said spring compresses the bracket 3, into the overhang formed by the top 8 of the side of the vehicle, after said bracket has been pivoted about said stud so that it is substantially parallel to the outside surface 16 of said side and the antenna is then positioned in it's storage position.

An arm 17 (FIGS. 2 and 3) extends substantially perpendicularly from the bracket member 3 at the second end 5 thereof.

A rotary mounting device 18 (FIGS. 2 to 4) rotatably mounts the antenna 1 on the arm 17 in a manner whereby in it's releasably securable extended position, shown in solid lines in FIG. 2, the antenna extends substantially parallel to the arm 17 and substantially perpendicular to the bracket member 3. In it's releasably securable storage position, shown by broken lines in FIG. 2 and shown in FIG. 3, the antenna 1 extends substantially parallel to and beyond the bracket member 3 and perpendicular to the arm 17. This enables the antenna to be hidden in the overhang, under the top 8 of the side of the back of the pickup truck 2, as shown in FIG. 3, when it is in it's storage position. The antenna 1 is thus substantially out of sight to people out of the truck when said antenna is in it's storage position.

A guide bushing 19 (FIGS. 2 and 3) coaxially extends through the bore 6 of the bracket member 3 and around the part of the stud 7 passing through said bore. The rotary mounting device comprises a pivotal mounting releasably secured by a wing nut 20 (FIGS. 2 to 4).

While the invention has been described by means of a specific example and in a specific embodiment, I do not wish to be limited thereto, for obvious modifications will occur to those skilled in the art without departing from the spirit and scope of the invention.

I claim:

1. An antenna mounting device for mounting a radio antenna on an automotive vehicle, said antenna mounting device comprising a bracket member having spaced opposite first and second ends, said bracket member having a bore formed therethrough in the area of the first end thereof;

a stud extending through the bore of the bracket member and mounted on the vehicle, said stud having spaced opposite ends and a head at each end;

a spiral spring coaxially positioned on the stud and extending between one head of the stud and the bracket member;

a cam member pivotally affixed to the bracket member at the first end thereof and having a projecting portion abutting the one head of the stud in one position to raise the bracket member on the stud and is spaced from the stud in another position to lower the bracket member;

an arm extending substantially perpendicularly from the bracket member at the second end thereof; and rotary mounting means rotatably mounting an antenna on the arm in a manner whereby in its releasably securable extended position the antenna extends substantially parallel to the arm and perpendicular to the bracket member and in its releasably securable storage position the antenna extends substantially parallel to and beyond the bracket member and perpendicular to said arm.

2. An antenna mounting device as claimed in claim 1, wherein the stud extends through a rear side of a pickup truck so that in its storage position the antenna is substantially out of sight to people out of the truck.

3. An antenna mounting device as claimed in claim 1, further comprising a guide bushing coaxially extending through the bore of the bracket member and around the part of the stud passing therethrough.

* * * * *